US005805961A

United States Patent [19]

Mizoe et al.

[11] Patent Number: 5,805,961

[45] Date of Patent: Sep. 8, 1998

[54] CHARGING MEMBER HAVING BRISTLESS, PROCESS CARTRIDGE, AND ELECTROPHOTOGRAPHIC APPARATUS EMPLOYING SUCH A CHARGING MEMBER

[75] Inventors: Kiyoshi Mizoe, Kawasaki; Shuichi Aita; Fumihiro Arahira, both of Yokohama; Yoshifumi Hano, Inagi, all of Japan

[73] Assignee: Canon Kabushiki Kaisha, Tokyo, Japan

[21] Appl. No.: 625,034

[22] Filed: Mar. 29, 1996

[30] Foreign Application Priority Data

Mar. 30, 1995 [JP] Japan ..... 7-072834
Jul. 31, 1995 [JP] Japan ..... 7-194515

[51] Int. Cl.[6] ..... G03G 15/02

[52] U.S. Cl. ..... 399/174; 361/221; 399/175; 399/176; 492/50

[58] Field of Search ..... 399/174–176; 492/50; 361/220, 221, 225

[56] References Cited

U.S. PATENT DOCUMENTS 4,371,252 2/1983 Uchida et al. ..... 399/175
5,225,878 7/1993 Asano et al. ..... 399/175 X
5,587,775 12/1996 Taniguchi et al. ..... 361/221 X
5,606,401 2/1997 Yano ..... 361/221 X

FOREIGN PATENT DOCUMENTS 63-149669 6/1988 European Pat. Off. .
0576203 12/1993 European Pat. Off. .
0615177 9/1994 European Pat. Off. .
6-274009 9/1994 Japan .
8-6357 1/1996 Japan .

*Primary Examiner*—William J. Royer
*Attorney, Agent, or Firm*—Fitzpatrick, Cella, Harper & Scinto

[57] ABSTRACT

A charging member, which electrically charges an object to be charged by being placed in contact with the object to be charged and by being applied with a voltage, is provided where the charging member includes an electroconductive base and brush bristles to come into contact with the object to be charged, and the brush bristles include at least one of etching fibers and divided fibers.

26 Claims, 2 Drawing Sheets

CHARGING MEMBER HAVING BRISTLESS, PROCESS CARTRIDGE, AND ELECTROPHOTOGRAPHIC APPARATUS EMPLOYING SUCH A CHARGING MEMBER

BACKGROUND OF THE INVENTION

1. Field of the Invention

The present invention relates to a charging member for image formation, and particularly to a charging member which uniformly charges an object with electricity when the charging member is brought into contact with the object and applied with a voltage.

The present invention also relates to a process cartridge and an electrophotographic apparatus employing the charging member.

2. Description of the Related Art

An image-forming apparatus like an electrophotographic apparatus usually employs a corona charging device or a contact charging device.

A contact charging device charges an object to be charged in contact with it under a DC voltage, or an oscillating voltage of AC-DC superposedly applied to the charging member. For example, as disclosed in Japanese Patent Application Laid-Open No. 63-149669, such a contact charging member forms an oscillating electric field of which the peak-to-peak voltage is twice as high as the initiation voltage of the object to be charged, between the contact charging member and the object to be charged to charge the object to be charged.

Following is an example of the constitution of a contact charging member.

FIG. 4 is a sectional view of a charging roller as a charging member. The charging roller 6 is constituted of an electroconductive base 3 (a mandrel) as a supporting member, an electroconductive elastic layer 4 having a necessary elasticity for forming an even nip with the object to be charged, and a chargeable layer 7 having a moderate resistivity for controlling the electric resistance of the charging roller 6.

The elastic layer 4 is composed of an electroconductive material made of a solid rubber such as an acrylic rubber, a urethane rubber, and a silicone rubber, and an electroconductive filler such as a metal oxide and carbon black dispersed in the rubber.

The chargeable layer 7 usually has a moderate resistivity, and is constituted not to cause poor electrification in the image-forming area even when the object to be charged has a defect such as a pin hole. The chargeable layer of moderate resistivity is formed by dip coating, spray coating, roller-transfer coating, or a like method, applying a liquid mixture of a resin such as acrylic resins, nylon resins, polyester resins, polyurethane resins, phenol resins, and styrene resins, and an electroconductive filler such as a metal oxide like titanium oxide and tin oxide, and carbon black dispersed therein.

Next, an image-forming apparatus equipped with the aforementioned contact-charging roller is explained using a laser beam printer of reversal development type as an example.

FIG. 6 shows a structure of a contact-charging apparatus 8. A charging roller 6 is placed approximately parallel to a photosensitive drum 9, the object to be charged. The charging roller is pressed against the photosensitive drum 9 with springs 10 provided at the both ends of the electroconductive base of the charging roller, to form a contact-nip of a given breadth. The charging roller is rotated in this pressed state, driven by the photosensitive drum rotating at a prescribed process speed, to charge successively the surface of the photosensitive drum. The numeral 17 indicates a power source.

FIG. 5 illustrates schematically a laser beam printer provided with a process cartridge having the aforementioned contact-charging member. A photosensitive member 9 is electrically charged with the contact-charging member 6 and scanned with a laser light beam 11 to form an electrostatic latent image on the surface of the photosensitive member. The formed electrostatic latent image is developed (by reversal development) into a toner image by a developing device 12. The toner image is transferred onto an image-receiving medium 14 delivered to the press-contact area between the transfer device 13 and the photosensitive member. After the image transfer, the remaining toner on the photosensitive member is removed by a cleaning device 15 to prepare the photosensitive member for subsequent image formation. The image-receiving medium after the toner image transfer is delivered to a fixation device 16 for toner-image fixation, is discharged from the apparatus as a copy. The electrophotographic photosensitive member 9, the charging member 6, the developing device 12, and the cleaning device 15 are integrated into a process cartridge 18 which is demountably placed in the main body of the printer with a guiding means like a rail 19.

The aforementioned contact-charging member which has a chargeable layer comprised of a resin and an electroconductive filler may abrade the photosensitive member during long term use and deteriorate the chargeability. One cause of the abrasion is the press-contact rotation of the contact-charging member. In the contact charging, however, a certain contact pressure is indispensable for uniform contact between the charging member and the photosensitive member to obtain sufficient chargeability. Further, the surface resistivity of the charging member may change and impair the chargeability thereof when any remaining toner after the toner image transfer, or powder chipped from the photosensitive member adheres to the surface of the charging member.

Two charging members formed from an electroconductive fiber material are disclosed in U.S. Pat. No. 4,371,252 and Japanese Patent Application Laid-Open No. 6-274009, respectively. The charging member disclosed in U.S. Pat. No. 4,371,252 is constituted of a base material, an elastic layer, an electrode layer, and a contact layer, and the contact layer which charges the photosensitive member by contact is comprised of a fiber assembly. The charging member disclosed in Japanese Patent Application Laid-Open No. 6-274009 is constituted of an electroconductive holder, an elastic core material, and an electroconductive nonwoven fabric to be in contact with the photosensitive member. Fibrous materials are promising because they cause less abrasion of the photosensitive member surface in comparison with the aforementioned resin layer.

However, a material of spun fiber generally does not come into sufficient contact with an object of charging, causing insufficient chargeability. Therefore, in contact charging using a fibrous charging member, various measures are taken at present, for example, raising of the contact pressure, to increase the contact area (nip) to prevent the drop of the chargeability. Consequently, the abrasion of the photosensitive layer is still not prevented satisfactorily in long term use. Furthermore, owing to the insufficient contact of the fibrous member with the photosensitive member, remaining toner or the like adheres to the fibrous member lowering the chargeability disadvantageously.

Also disclosed is another type of charging member employing an elastic layer composed of a low-hardness rubber or a foamed material to obtain sufficient contact at a low contact pressure for the purpose of preventing surface abrasion of the photosensitive member. Although the low hardness of the elastic layer reduces the abrasion of the photosensitive member in comparison with conventional charging members, the abrasion is not completely prevented owing to the friction between the resin charging layer and the photosensitive member.

Contact charging is divided into roughly two groups. The conventional one is to use electric discharge. The other is to inject the charge as described in EPA576203 and EPA615177, in which a charge injection layer is provided as the surface layer of the photosensitive member and electric charge is injected directly from the charging member into the surface layer. This injection charging method, which does not utilize electric discharge, is highly advantageous in lowering the applied voltage and preventing ozone generation. In the injection charging method, however, the contact characteristic of the charging member greatly affects the chargeability in comparison with the conventional contact discharging since the charge is injected only through the contact points between the charging member and the charge injection layer. Therefore, when a conventional charging member having a resin surface layer or a brush is used in the injection charging, a drop of chargeability owing to insufficient contact may occur more markedly.

SUMMARY OF THE INVENTION

An object of the present invention is to provide a charging member which has excellent contact with an object to be charged.

Another object of the present invention is to provide a charging member which does not much abrade the surface of an object to be charged much.

Still another object of the present invention is to provide a charging member which can uniformly charge an object to be charged repeatedly.

A further object of the present invention is to provide a process cartridge and an electrophotographic apparatus employing the above charging member.

According to one aspect of the present invention, there is provided a charging member which charges an object to be charged by being placed in contact with the object to be charged and by being applied with a voltage, comprising an electroconductive base and brush bristles in contact with the object to be charged, the brush bristles comprising at least one of etching fibers and divided fibers.

According to another aspect of the present invention, there is provided a process cartridge employing the above charging member.

According to still another aspect of the present invention, there is provided an electrophotographic apparatus employing the process cartridge.

DESCRIPTION OF THE PREFERRED EMBODIMENTS

Figure 1:
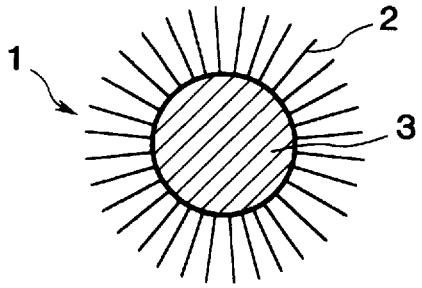
FIG. 1 is a sectional view of a charging brush roller of the present invention.

The charging member of the present invention is placed in contact with an object to be charges to charge the object by being applied with a voltage. It comprises an electroconductive base and brush bristles for contact with the object and the brush bristles comprise at least one of etching fibers and divided fibers.

The contact brush bristles in the present invention are filaments woven into a base fabric such as a woven fabric, a nonwoven fabric, and a like sheet material by W weaving, V weaving, or a like weaving technique, or filaments implanted onto a base fabric by electrostatic implanting or adhesion to form a brush.

The filament constituting the contact brush bristle has an average diameter F in the range of $$0.05\ \mu m \leqq F \leqq 30\ \mu m.$$

In the above range, the contact brush bristles can achieve satisfactory contact with the photosensitive member, and are capable of charging it uniformly over a long term even under specific conditions such as high temperature and high humidity, or low temperature and low humidity. Further, owing to the large specific surface area, the bristles adsorb and clean fine particles to remove effectively a remaining toner after the toner image transfer. The above average filament diameter F is measured by taking an electron microphotograph, then 10 areas are selected randomly in the microphotograph and 10 fibers in each area are measured for the fiber diameter (n=100) to calculate the average.

With the average filament diameter F less than 0.05 $\mu$m, the durability of the brush becomes low and the initial image quality may not be maintained, although the abrasion prevention of the photosensitive member is satisfactory. With increase of the average diameter F, the area of contact with the object of charging decreases, and the bristles of the average diameter F of larger than 30 $\mu$m require higher voltage application for uniform charging.

The brush having contact brush bristles of the present invention has a resistance R preferably in the range:

$$1\times10^{3}\Omega \leqq R \leqq 1\times10^{9}\Omega.$$

Use of the contact brush having the resistance R of lower than $1\times10^{3}$ Ω may cause leakage in the presence of a pinhole on the photosensitive member to result in insufficient charging, whereas use of the contact brush having the resistance R of higher than $1\times10^{9}$ Ω may cause nonuniform charging. The resistance of the contact brush bristles is calculated from the electric current which flows from the contact brush bristles to an electroconductive metal member rotating in contact with it under application of DC 100 V.

The etching fiber used in the present invention is produced by treating a fiber with an acid or an alkali to chemically remove a specific component from the fiber components. The etching fiber includes synthetic fibers, natural fibers, semisynthetic fibers, and regenerated fibers. The synthetic fibers include specifically polyamides such as nylon-6, nylon-66, nylon 12, nylon 46, and aramides; polyesters such as polyethylene terephthalate (PET); polyolefins such as polyethylenes (PE) and polypropylenes (PP); polyvinyl alcohols, polyvinyl chlorides, polyvinylidene fibers, polyacrylonitrile fibers, polyphenylene sulfide fibers, polyurethane fibers, polyfluoroethylene fibers, carbon fibers, and glass fibers. The natural fibers include specifically silk, cotton, wool, and hemp. The semisynthetic fibers include specifically acetate fiber. The regenerated fibers include specifically rayon and cuprammonium rayon.

A conjugate fiber produced from two or more of the above fiber materials by conjugate spinning may be used in the present invention. The conjugate fiber for chemical etching includes core-sheath type fibers which give a single ultrafine fiber, and sea-island type fibers which give plural ultrafine fibers. An example of such a conjugate fiber is a fiber produced by conjugate spinning of a hydrolyzable resin such as a polyester and a non-hydrolyzable resin such as a polyamide, a polyolefin, and a polyacrylic resin. The conjugate fiber is treated with an acid, an alkali, or the like for hydrolysis to obtain the non-hydrolyzable resin fibers. Alternatively, the conjugate fiber can be produced by conjugate spinning of a solvent-soluble resin and a solvent-insoluble resin.

A sea-island type fiber, for example, is produced from a hydrolyzable PET as the sea and a non-hydrolyzable nylon-6 as the islands by conjugate spinning, and the resulting conjugate fiber is treated with an alkali such as aqueous sodium hydroxide and aqueous potassium hydroxide for hydrolysis to remove the PET sea component, thus leaving the nylon-6 islands as ultrafine fibers.

The divided fiber used in the present invention can be produced by splitting a fiber utilizing the difference in thermal contraction coefficients, or adding an external force, and derived from aforementioned synthetic fibers, natural fibers, semi-synthetic fibers, and regenerated fibers.

Specifically, non-compatible thermoplastic resins are spun by conjugate spinning, and the resulting fiber is stretched and heat-treated, thereby the fiber is opened and split due to the difference between the contraction rates of the components. An example of the combination of the non-compatible thermoplastic resins is a polyester and a nylon or polypropylene.

Alternatively, the divided fiber may be produced by splitting a fiber by high-pressure water ejection or needle punching to form ultrafine filaments. In this process, for more efficient fiber splitting, the conjugate fiber may be employed which is composed of resins having different contraction coefficients for formation of the ultrafine filaments. An example of combination of the non-compatible thermoplastic resins is a polyester and a nylon or polypropylene.

The etching fibers and the divided fibers have fine surface roughness, which enables sufficient contact with the object to be charged to achieve uniform charging. This effect is particularly marked in injection charging.

The contact brush bristles can be made electroconductive in the present invention, for example, by using a resin which is electroconductive by itself, by adding of an electroconductive filler before the spinning, or by applying an electroconductive polymer such as electron-conjugative polymers for electroconductivity. The aforementioned electroconductive filler includes powdery metals such as iron, copper, and silver; powdery composite metals such as zinc oxide, tin oxide, titanium oxide, and copper sulfate; or electroconductive powdery carbon such as carbon black. Of these methods, blending of electroconductive powdery carbon and treatment with electron-conjugative polymer for electroconductivity are preferred. Particularly preferable is the treatment with electron-conjugative polymer for electroconductivity.

The suitable electron-conjugative polymer includes polypyrrole, polythiophene, polyquinoline, polyphenylene, polynaphthylene, polyacetylene, polyphenylene sulfide, polyaniline, polyphenylene vinylene, and polymers containing a pyrrole derivative or a thiophene derivative. These polymers may be used singly or in combination of two or more thereof. Of these, particularly preferable are polypyrrole and polythiophene having heterocycles in the polymer molecule, polyaniline having nitrogen atoms and homocycles in the polymer molecule, and polymers containing a derivative thereof, because of the high-voltage resistance and maintenance of stable electric resistance for a long period of time.

The impartment of the electroconductivity by an electroconductive polymer is conducted, for example, by any of the methods as follows: (1) a polymerization initiator is impregnated into, or applied onto the fiber, and a precursor monomer of the electroconductive polymer is brought into contact to polymerize on the surface of the fiber, (2) the monomer is impregnated in or applied onto the fiber, and then a polymerization initiator is brought into contact therewith to cause polymerization on the surface of the fiber, and (3) a solution of an electroconductive polymer in a solvent is directly impregnated into, or applied onto the fiber. The monomer is used in a vapor or solution state, and the impregnation or coating is conducted by dipping, spray coating, roller transfer, or a like method.

The impartment of the electroconductivity to the fiber may be conducted, in any step of the charging member production process, to the fibers, to the brush bristles, or to the charging member.

The method of application of the electroconductive polymer is described below specifically.

Polypyrrole is applied, for example, as follows. PET fiber is dipped in aqueous 10 weight % ferric chloride solution (an oxidation catalyst) for 2 hours to adsorb ferric chloride. The excess of the aqueous solution is removed by air drying or roll pressing. The fiber is placed in a closed vessel filled with a vapor of a pyrrole monomer. Thereby the pyrrole monomer undergoes gas-phase polymerization to form electroconductive polypyrrole on the fiber. The electroconductivity can be controlled as desired by adjusting the amount (or concentration) of the monomer filled in the vessel, gas-phase polymerization time, the amount of the polymerization catalyst, the polymerization temperature, and other conditions. After the reaction, the fiber is sufficiently washed, and dried by heating. The state of the dried brush bristles is adjusted as desired from an upright state to a slanting state, for example, by centrifugal rotation of the brush under high humidity conditions.

Also the polymerization of the pyrrole monomer on the fiber may be conducted by immersing the fiber applied with a polymerization catalyst thereon into liquid pyrrole monomer. In this polymerization, the electric resistance can be controlled by dilution of the liquid pyrrole monomer with a suitable solvent, and control of polymerization reaction time.

When polyaniline is used as the soluble electroconductive polymer, the polyaniline is applied as follows. Firstly, soluble polyaniline is prepared by chemical oxidation polymerization in the presence of ammonium peroxodisulfate (an oxidant) and sulfuric acid (a protonic acid), and treating it with aqueous ammonia. The obtained polymer is dissolved in NMP solvent in a concentration in the range of from 1 to 10 % by weight. This solution is applied onto the fiber by spray coating, and the solvent is removed by heating or by vacuum. Thereby the fiber is made electroconductive. As the solvent for polyaniline, the most suitable is N-methyl-2-pyrrolidone (NMP), but N,N-dimethylacetamide and N,N-dimethylformamide are also suitable.

In order to improve impregnation or coating of the precursor monomer of the electroconductive polymer, the polymerization catalyst, and the electroconductive polymer solution, the fiber may be modified by etching with an acid, an alkali, or an organic solvent, or treating with a coupling agent or the like.

The base fabric into which the contact brush bristles are woven or implanted in the present invention includes woven fabrics of synthetic fiber, natural fiber, semi-synthetic fiber, regenerated fiber etc. as mentioned above, by plain weaving etc.; non-woven fabrics produced from short fibers of the above-mentioned fibers; and a sheet made from a resin or rubber.

The material for the electroconductive base includes metals and alloys such as aluminum, aluminum alloys, and stainless steel; and resins containing electroconductive particles dispersed therein such as electroconductive carbon black, metal particles, and electroconductive metal oxide particles. The electroconductive base may be in a shape of a bar, a plate, an angle bar, a blade, or the like.

In the present invention, an electroconductive elastic layer may be provided between the base fabric of the contact brush and the electroconductive base. The elastic material therefor includes synthetic rubbers such as EPDM, NBR, butyl rubber, acrylic rubber, urethane rubber, polybutadiene, butadiene-styrene rubber, butadiene-acrylonitrile rubber, polychloroprene, polyisoprene, chlorosulfonated polyethylene, polyisobutylene, isobutylene-isoprene rubber, fluororubber, and silicone rubber; and natural rubber. Such an elastic material may be blown, if desired, into a foam of a suitable cell size by use of a blowing agent or the like. The elastic material can readily be made electroconductive by addition of an electroconductive filler. The electroconductive filler includes powders and fibers of metals such as aluminum, nickel, stainless steel, palladium, zinc, iron, copper, and silver; powdery compound metals such as zinc oxide, tin oxide, copper sulfide, and zinc sulfide; and powdery carbons such as acetylene black, Ketjen black, PAN type carbon, and pitch type carbon. These fillers may be used singly or in combination of two or more thereof.

The charging member having the contact brush bristles of the present invention may be in a shape of a roller, a blade, a belt, or the like. Of these, the roller type and the belt type are preferred.

Examples of the constitution of the charging member of the present invention are described below.

FIG. 1 shows a charging brush roller 1. A brush fabric comprised of a base fabric and contact brush bristles 2 implanted thereon is attached around an electroconductive base (metal core) 3. The attachment is conducted, for example, by winding a narrow strip of the brush fabric to the metal core, or by sticking a brush fabric of the brush size around the core metal.

Figure 2:
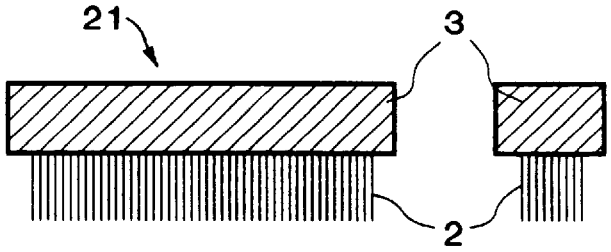
FIG. 2 shows a front view and a side view of a charging brush blade of the present invention.

FIG. 2 shows a charging blade 21. A brush fabric comprised of a base fabric and contact brush bristles 2 implanted thereon is attached to a blade-shaped electroconductive base 3. The blade may be moved in oscillation, forward and backward, or leftward and rightward by means of a vibrator (not shown in the drawing).

Figure 3:
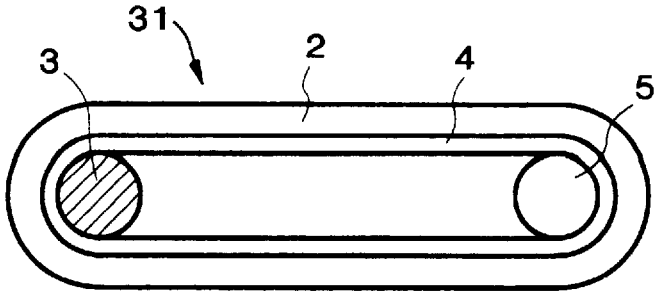
FIG. 3 is a sectional view of a charging brush belt of the present invention.
Figure 4:
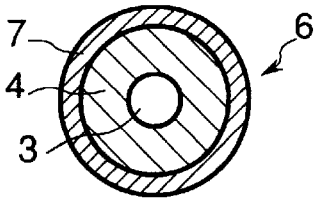
FIG.4 PRIOR ART
FIG. 4 is a sectional view of a conventional charging roller.

FIG. 3 shows a belt-type charging member 31. Numeral 2 indicates contact brush bristles 2, and numeral 4 an electroconductive elastic layer. The belt 4 is held between an electroconductive base 3 serving as a driving roll and a driven roller 5, to be driven. The contact brush of the present invention is stuck onto the belt 4. The attachment of the contact brush is conducted, for example, by winding a narrow strip of the contact brush fabric in a spiral manner as shown in FIG. 1, or by forming a broad brush fabric into a tube corresponding to the rotating belt. In place of the two-axis belt driving system in FIG. 3, the belt may be driven by a three (or more) roller system where the driving roller in FIG. 3 is replaced with a second driven roller and a driving roller is newly provided.

The photosensitive member which is the object to be charged in the present invention is of any type having at least a photosensitive layer formed on an electroconductive supporting member. If necessary, a protection layer or a charge injection layer may be formed on the photosensitive layer.

The charge injection layer has a volume resistivity adjusted in the range preferably of from $1\times10^{8}$ to $1\times10^{15}$ Ωcm, more preferably from $1\times10^{10}$ to $1\times10^{15}$ Ωcm to prevent image smearing, and still more preferably in the range of from $1\times10^{12}$ to $1\times10^{15}$ Ωcm to prevent image smearing and to achieve sufficient charging even under a rapid change of environmental conditions.

With the volume resistivity of lower than $1\times10^{8}$ Ωcm, the holding of an electrostatic latent image is liable to become incomplete and to cause image smearing, whereas with the volume resistivity of higher than $1\times10^{15}$ Ωcm the injection of the electric charge from the charging member is liable to be insufficient, causing insufficient charging.

The volume resistivity of the charge injection layer is measured as follows. A charge injection layer is formed on an electroconductive film vapor-deposited on a polyethylene terephthalate (PET) sheet and the measurement is conducted at a temperature of 23° C. and humidity of 65% by application of a voltage of 100 V with a volume resistivity tester (4140B pAMATER, Hewlett Packard Co.).

The charge injection layer in the present invention includes: (1) a resin layer consisting of an insulating binder resin and a suitable amount of light-transmissive and electroconductive particles dispersed therein, (2) an inorganic layer constituted of a semiconductor or the like, and (3) an organic layer constituted of an electroconductive polymer.

The charge injection layer formed on the surface of the photosensitive member serves to hold the charge injected from the charging member at a holding efficiency of 90% or higher, and also serves to release the charge on image exposure to the support of the photosensitive member to lower the residual potential.

The charge injection layer is explained specifically below.

In the above-mentioned resin layer (1), the binder resin includes polyester resins, polycarbonate resins, polystyrene resins, fluororesins, cellulose resins, vinyl chloride resins, polyurethane resins, acrylic resins, epoxy resins, silicone resins, alkyd resins, and vinyl chloride-vinyl acetate copolymer resins. The material for the electroconductive fine particles includes metals such as copper, aluminum, silver, and nickel; metal oxides such as zinc oxide, tin oxide, antimony oxide, titanium oxide, and solid solutions and fusion-bonded matters thereof: and electroconductive polymers such as polyacetylene, polythiophene, and polypyrrole. In view of the light-transmittance of the photosensitive member, highly transparent metal oxides such as tin oxide are preferred.

The particle diameter of the electroconductive fine particles is preferably not larger than 0.3 μm, more preferably not larger than 0.1 μm in view of light transmissivity. The content thereof in the charge injection layer is preferably in the range of preferably from 2% to 280% by weight based on the binder resin depending on the particle size. With the content lower than 2% by weight, control of the resistivity of the charge injection layer may be difficult, and with the content higher than 280% by weight, the film forming ability of the binder resin is sometimes impaired partially.

Various additives can be added to the charge injection layer to improve dispersibility of the electroconductive fine particles, adhesiveness of the fine particles and the binder resin, and the surface smoothness of the formed film. For improvement of the dispersibility, use of a coupling agent or a leveling agent is highly effective to modify the surface of the electroconductive fine particles. Further, to improve the dispersibility, use of a curable resin as the binder resin is effective.

When a curable resin is used for the charge injection layer, a coating liquid composed of a solution of a curable monomer or curable oligomer and electroconductive fine particles dispersed therein is applied on the photosensitive layer, and the formed film is cured by heating or light irradiation to form a surface layer. The curable resin includes acrylic resins, epoxy resins, phenol resins, and melamine resins, but is not limited thereto. Any resin is useful therefor which can be cured after coating by chemical reaction caused by application of energy such as light or heat.

The charge injection layer is formed by application of a solution or a dispersion containing a binder resin, electroconductive particles, and an optionally added additive on the photosensitive member, and drying the resulting coating film. The thickness of the charge injection layer is in the range of preferably from 0.1 to 10 μm, and more preferably from 0.5 to 5 μm.

The charge injection layer may contain a powdery lubricant, which decreases friction between the photosensitive member and the charging member, friction between the photosensitive member and the cleaning member to reduce the mechanical load of the electrophotographic apparatus, and improves releasability of the surface of the photosensitive member to prevent adhesion of developing particles (toner particles). The particulate lubricant is preferably selected from resins exhibiting a low critical surface tension such as fluororesins, silicone resins, and polyolefin resins. Particularly preferred are poly(tetrafluoroethylene) resins. The powdery lubricant is added in an amount ranging preferably from 2% to 50% by weight, more preferably from 5% to 40% by weight based on the binder resin. With the content lower than 2% by weight, the chargeability is not sufficiently improved. With the content higher than 50% by weight, the image resolution and the sensitivity of the photosensitive member tend to be impaired.

The aforementioned charge injection layer (2) constituted of an inorganic material is exemplified by a semiconductor layer formed from amorphous silicon.

Such a silicon photosensitive member can be produced by using photoconductive amorphous silicon as the photosensitive layer and high-frequency glow discharge decomposition by means of a plasma chemical vapor deposition apparatus.

The aforementioned charge injection layer (3) constituted of an electroconductive polymer is exemplified by layers of electron conjugative polymer such as polypyrrole, polythiophene, and polyaniline, and layers of organic polysilanes.

The photosensitive layer of the present invention may be either of a lamination layer type having a charge-generating layer and a charge-transporting layer, or of a single layer type having a layer containing both a charge-generating substance and a charge-transporting substance. The charge-transporting layer has a thickness of preferably from 5 to 40 μm, and the charge-generating layer has a thickness of preferably from 0.05 to 5 μm.

The charge-generating substance includes organic materials such as phthalocyanine pigments and azo pigments, and inorganic materials such as silicon compounds.

The charge-transporting substance includes hydrazone compounds, styryl compounds, triarylamine compounds, and triarylmethane compounds.

Additionally, an interlayer may be provided between the charge injection layer and the photosensitive layer or between the electroconductive support and the photosensitive layer. The interlayer is provided to improve adhesion of the layers, or to serve as a barrier layer for the electric charge. The interlayer may be made from a resin material such as epoxy resins, polyester resins, polyamide resins, polystyrene resins, acrylic resins, and silicone resins.

The electroconductive support for the photosensitive member may be made from a material including metals such as aluminum, nickel, and stainless steel, plastic materials or glass having an electroconductive layer, and paper having imparted electroconductivity.

The present invention is described below in more detail by reference to examples.

EXAMPLE 1

A sea-island type conjugate fiber constituted of polyethylene terephthalate (sea portion), and nylon-66 (island portion, element number: 15)(average diameter: 25 μm) was woven into a nylon base fabric in U-shape pattern to form a brush (brush bristle length: 3 mm).

This brush was immersed in an aqueous solution of 3% by weight sodium hydroxide at 90° C. for 20 minutes for hydrolysis. This solution was neutralized with dilute hydrochloric acid, and the brush was dried. Thus prepared was a brush having brush bristles of ultrafine nylon fibers of which average diameter is 0.5 μm. This brush was wound to the stainless steel core of 10 mm diameter (electroconductive base) to obtain a roller-shaped charging member.

The charging roller was set on a rotating member, and thereto a solution of electroconductive polyaniline in NMP was sprayed for coating. After drying, the contact brush had a resistance of $4\times10^4$ Ω at room temperature.

This charging roller is referred to as "K-1".

EXAMPLE 2

A conjugate fiber of a hollow circular side-by-side type (element number: 8, average diameter: 20 μm) composed of polyethylene terephthalate and polypropylene was woven into a nylon fiber base fabric in a U-shape pattern to prepare a brush having brush bristles of 3 mm length.

The brush bristles were treated for hydrolysis with an aqueous solution of 1% by weight potassium hydroxide at 110° C. to obtain a brush having bristles of ultrafine polypropylene fiber of which average diameter is 1 μm.

The brush was immersed in an aqueous ferric chloride solution of 10% by weight for 30 minutes, and then placed in a closed vessel filled with pyrrole vapor at 15° C. for one hour to cause vapor-phase oxidation polymerization. After the reaction, the brush was washed with ethanol sufficiently, and dried at 100° C. After the drying, the contact brush had a resistance of $5\times10^6$ Ω at room temperature.

The brush was stuck onto a blade-shaped stainless steel sheet (electroconductive base) to prepare a blade type charging member. This charging blade is referred to as "K-2".

EXAMPLE 3

A core-sheath type conjugate fiber (average diameter: 13 μm) comprised of polyethylene terephthalate (sheath) and polyacrylonitrile (core) was woven into a nylon fabric base in a U-shape pattern to prepare a brush having brush bristles of 3 mm length.

The brush bristles were treated for hydrolysis with an aqueous solution of potassium hydroxide (1% by weight) at 100° C. to obtain a brush having bristles of ultrafine polyacrylonitrile fiber of which average diameter is 2 $\mu$m.

The brush was immersed in an aqueous copper chloride solution of 20% by weight for 30 minutes, and then placed in a closed vessel filled with pyrrole vapor at 25° C. for 2 hours to cause vapor-phase oxidation polymerization. After the reaction, the brush was washed successively with pure water and ethanol sufficiently, and dried at 100° C. After the drying, the contact brush had a resistance of $5\times10^5$ Ω at room temperature.

Separately, on a stainless steel core (electroconductive base) of 6 mm diameter, an elastic layer of a silicone rubber containing dispersed electroconductive titanium oxide and electroconductive carbon black was provided concentrically.

The aforementioned brush, having been made electroconductive, was wound to the elastic layer to prepare roller-shaped charging member. This charging blade is referred to as "K-3".

Comparative Example 1

A contact brush was prepared in the same manner as in Example 1 except that hydrolysis was not conducted.

A charging member of roller type was prepared by winding the brush to a stainless steel core. This charging roller is referred to as "H-1".

[Evaluation Method]

Figure 5:
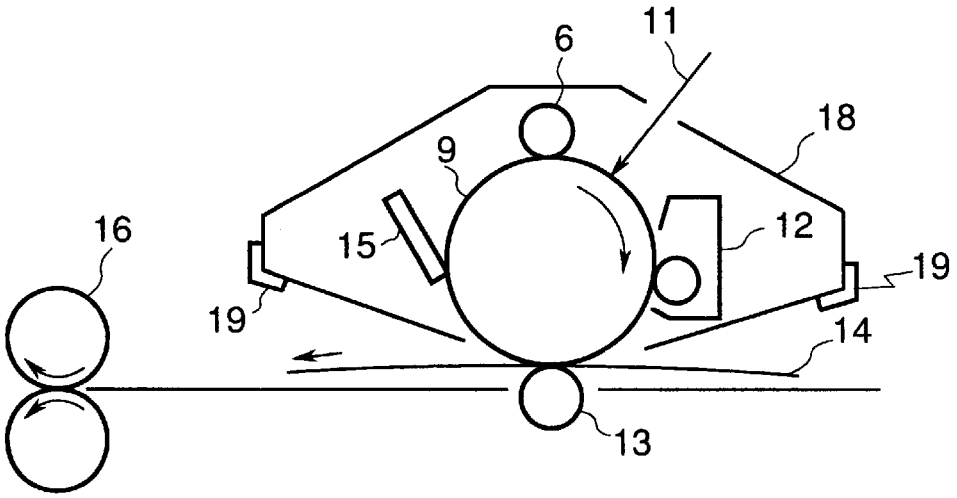
FIG. 5 illustrates a construction of the main portion of a laser beam printer provided with a process cartridge having the contact-charging member.

The charging member (K-1, K-2, K-3, or H-1) was set in an electrophotographic apparatus (laser beam printer) shown in FIG. 5, and was brought into contact with the photosensitive member at a press-contacting load of 1 kg. The photosensitive member was the one having a charge transporting layer as the surface layer with no charge injection layer.

The electrophotographic apparatus was set at a process speed of 16 sheets per minute at a resolution of 600 dpi. A durability test on image formation was carried out with application of a prescribed voltage to the charging roller driven by rotation of the photosensitive member.

When a charging blade was is employed as the charging member, it was fixed on a protection jig which was a modified contact charging device originally designed for a charging roller, and was brought into contact with the photosensitive member in a fixed state.

The image printing was conducted under environmental conditions of high-temperature and high humidity H/H (32.5° C., 85%), ordinary-temperature and ordinary-humidity N/N (23° C., 60%), and low-temperature and low-humidity L/L (15° C., 10%). The applied voltage was AC-DC superposition (AC: 1.4 $KV_{pp}$, and DC: −700 V), or DC (−1400 V). The durability test was conducted for 20,000 sheets of printing.

For evaluation of the image quality, whiteness of the white area of the transfer-receiving paper was measured before and after the printing by means of a reflectometer (TC-6DS, Tokyo Denshoku K. K.). Fogging (%) was calculated from the difference of the whiteness of the transfer-receiving paper before and after the printing. Fogging of 5% or more means deterioration of image quality.

Evaluation was made on the following two points: (1) change of fogging during the durability test due to the abrasion of the drum, and (2) image fogging under DC charging at the initial stage.

The image quality was evaluated by four grades as shown in Table 1 below, using 5% fogging as a border line.

TABLE 1

(Drum Abrasion and Evaluation Grade of Image Quality)

| | Image fogging level |
|---|---|
| Excellent | 0% to less than 2% |
| Good | 2% to less than 5% |
| Fair | 5% to less than 8% |
| Poor | Not less than 8% |

[Results of Evaluation]

The evaluation results of Examples 1–3 and Comparative Example 1 are shown in Table 2.

The charging member of the present invention did not cause fogging which would result from abrasion of the photosensitive member during the durability test, and conducted uniform charging for a long term. Further, even in charging by DC application, the image fogging is not more than 5%, which shows satisfactory chargeability.

On the other hand, the charging member H-1, which had been prepared without chemical etching of the fiber gradually abraded the surface of the photosensitive member to cause insufficient charging. In particular, the chargeability was remarkably decreased under the environmental conditions of H/H. The charging member of Comparative Example 1 exhibited low chargeability under DC charging, and caused marked fogging.

TABLE 2

(Results of Image Quality Evaluation in Examples 1–3 and Comparative Example 1)

| Charging member * | Environmental conditions | Non-occurrence of drum abrasion and fogging (AC 1.8 $KV_{pp}$ + DC-700 V) Initial stage | After endurance test | Fogging in DC application Initial stage |
|---|---|---|---|---|
| K-1 | L/L | Excellent | Excellent | Excellent |
| | N/N | Excellent | Excellent | Excellent |
| | H/H | Excellent | Excellent | Excellent |
| K-2 | L/L | Excellent | Excellent | Excellent |
| | N/N | Excellent | Excellent | Excellent |
| | H/H | Excellent | Excellent | Excellent |
| K-3 | L/L | Excellent | Excellent | Excellent |
| | N/N | Excellent | Excellent | Excellent |
| | H/H | Excellent | Excellent | Excellent |
| H-1 | L/L | Good | Fair | Fair |
| | N/N | Good | Fair | Fair |
| | H/H | Good | Fair | Good |

*K-1: Example 1, K-2: Example 2, K-3: Example 3
H-1: Comparative Example 1

Photosensitive Member Preparation Example 1

Five layers were provided on an aluminum cylinder of 30 mm diameter. The layers are referred to as first, second, third, fourth, and fifth layers in the order from the aluminum cylinder.

The first layer was an electroconductive layer which is an electroconductive thin layer of 20 $\mu$m thick to cover defects or the like of the aluminum cylinder and to prevent formation of moire by reflection of laser exposure light.

The second layer was a positive charge injection-preventing layer (subbing layer) which prevents neutralization of the negative charge formed on the photosensitive member by the positive charge injection from the aluminum cylinder. This layer was 1 μm thick and made from an amylan resin and methoxymethylated nylon to have adjusted resistivity of about $10^6$ Ωcm.

The third layer was a charge-generating layer which is a resin layer of about 0.3 μm thick, containing a disazo pigment dispersed therein, and can generate positive-negative charge pairs on laser beam irradiation.

The fourth layer was a charge-transporting layer which is a p-type semiconductor layer of 20 μm thick composed of a polycarbonate resin and a hydrazone dispersed therein. This layer has a function of transporting positive charges generated in the charge-generating layer to the surface of the photosensitive member, but the negative charges formed on the photosensitive member cannot move through this layer.

The fifth layer was a charge-injection layer which is a resin layer of 3 μm thick composed of a photo-set acrylic resin and tin oxide dispersed therein. The tin oxide used in the present invention was an ultrafine particulate tin oxide doped with antimony to be electroconductive having a particle diameter of about 0.03 μm. The ultrafine tin oxide was dispersed in an amount of 160% by weight based on the photo-setting acrylic resin as the binder resin. Further, 25% by weight of tetrafluoroethylene resin particles and 1% by weight of a dispersant were dispersed in the charge-injection layer for improving surface slipperiness. The surface layer of the photosensitive member had a volume resistivity of $3\times10^{13}$ Ωcm.

This photosensitive member is referred to as "Photosensitive Member-1".

Photosensitive Member Preparation Example 2

A photosensitive member was prepared in the same manner as in Photosensitive Member Preparation Example 1 except that $SnO_2$ particles in the fifth layer were dispersed in an amount of 250% by weight based on the photo-setting acrylic resin. The surface layer of the photosensitive member had a volume resistivity of $2\times10^9$ Ωcm.

This photosensitive member is referred to as "Photosensitive Member-2".

Photosensitive Member Preparation Example 3

An amorphous silicon photosensitive member which is constructed of a mirror-polished aluminum cylinder of 30 mm diameter, and an inhibition layer, a photoconductive layer, and a surface layer (charge injection layer) was prepared by applying glow discharge on a mirror-polished aluminum cylinder.

Firstly, a reaction chamber was evacuated to a vacuum of about $5\times10^{-3}$ Pa, and onto the surface of the aluminum cylinder maintained at 250° C. in the reaction chamber, the gases of $SiH_4$, $B_2H_6$, NO, and $H_2$ were introduced in a flow method. When the internal pressure reached about 30 Pa, glow discharge was allowed to form an inhibition layer of 5 μm thickness.

Then, a photoconductive layer was formed in the same manner as the inhibition layer in a thickness of 20 μm using $SiH_4$ and $H_2$ gases under the internal pressure of about 50 Pa.

Further, a surface layer composed of Si and C was formed using $SiH_4$, $CH_4$, and $H_2$ gases by glow discharge at the internal pressure of about 60 Pa to a layer thickness of 0.5 μm. The surface layer of the photosensitive member had a volume resistivity of $8\times10^{12}$ Ωcm.

This photosensitive member is referred to as "Photosensitive Member-3".

EXAMPLE 4

A brush was prepared by weaving a divided fiber composed of polyethylene terephthalate (PET) and nylon-6 having an orange type sectional shape (fiber diameter after splitting: 1.5 μm) onto a nylon base fabric. A high-pressure water stream was projected thereon to open the divided fiber.

The obtained brush was immersed into an aqueous solution of 15% by weight ferric chloride for 2 hours, and then placed in a closed vessel filled with pyrrole monomer vapor to allow polymerization for 3 hours to form polypyrrole on the surface of the fibers. After the reaction, the brush was washed successively with pure water and ethanol sufficiently, and dried at 110° C. After the drying, the brush was wound to a metal core of 12 mm diameter in a spiral fashion to obtain a charging member. Further, this charging member was placed in a thermostat filled with water vapor, and was rotated to make the brush bristles straight and to make the fiber opening state uniform.

The bristle density was 1,100,000 fibers per square inch, the contact brush bristles were 3.5 mm long, and the resistance of the charging member was $3\times10^6$ Ω.

EXAMPLE 5

A brush was prepared by weaving a sea-island type conjugate fiber into a nylon base fabric in a U-shape pattern. The conjugate fiber was comprised of PET (sea portion) and nylon-66 (island portion).

The brush was immersed into an aqueous solution of 2% by weight sodium hydroxide and kept at 80° C. for one hour. It was neutralized with dilute hydrochloric acid, and dried to obtain a brush having brush bristles of ultrafine nylon of fiber diameter of 0.7 μm.

The brush was wound to a metal core bar of 6 mm diameter to obtain a charging member.

The charging member was set on a rotating member, and a solution of electroconductive polyaniline (2% by weight) in NMP was sprayed thereon to form a coating layer.

The fiber density was 1,500,000 fibers per square inch, each contact brush bristle was 3.0 mm long, and the resistance of the charging member was $7\times10^8$ Ω.

EXAMPLE 6

A brush was prepared by weaving a conjugate fiber composed of PET and polypropylene into a nylon base fabric in a U-shape pattern. The PET component was removed by dissolution treatment with an aqueous potassium hydroxide (1% by weight) solution at 90° C. Thereby, a contact brush was obtained having bristles of an ultrafine polypropylene fiber of 1 μm in diameter.

The brush was treated with a silane coupling agent (aminopropyltrimethoxysilane) for hydrophilicity, and then immersed in an aqueous ferric chloride solution (10% by weight) for one hour, and then placed in a closed vessel filled with pyrrole vapor at 20° C. for one hour to cause vapor-phase oxidation polymerization. After the reaction, the brush was washed successively with water and ethanol sufficiently, and dried at 110° C.

The fiber density was 800,000 fibers per square inch, the contact brush bristles were 3.0 mm long, and the resistance of the charging member was $2\times10^7$ Ω.

EXAMPLE 7

A brush was prepared in the same manner as in Example 4. The reverse face of the base fabric of the brush was stuck onto the face of a driven rubber belt of a two-axis rotating system to obtain a charging belt.

The belt was held such that a driving roller and a driven roller of 6 mm diameter were adjusted to have a nip breadth of 10 mm on the photosensitive member. The belt was rotated counter to the rotating direction of the photosensitive member by the driving roll of which one end of the metal core was connected to an external driving device. The driving roller and the driven roller were constituted respectively of a stainless steel metal core and an electroconductive rubber sheet of 0.2 μm thick wound thereon.

Comparative Example 2

On a stainless metal core of 6 mm diameter, a rubber foam layer was concentrically disposed. The rubber foam layer was made from EPDM containing Ketjen black and carbon black mixedly dispersed therein (average cell diameter: 90 μm). It was processed to obtain an outside diameter of 13 mm to prepare a charging member. The charging member had a resistance of $7\times10^4$ Ω.

Comparative Example 3

A charging member was prepared in the same manner as in Example 4 except that the brush prepared in Comparative Example 1 was used.

Comparative Example 4

A charging member was prepared by coating the surface of the rubber foam roller of a charging member prepared in the same manner as in Comparative Example 2. Coating was done using an aqueous acrylic resin mixed with a tin oxide slurry (to a solid content of 30% by weight) by dip coating.

The thickness of the surface layer was 70 μm, and the resistance of the charging member was $6\times10^6$ Ω.

[Results]

Figure 6:
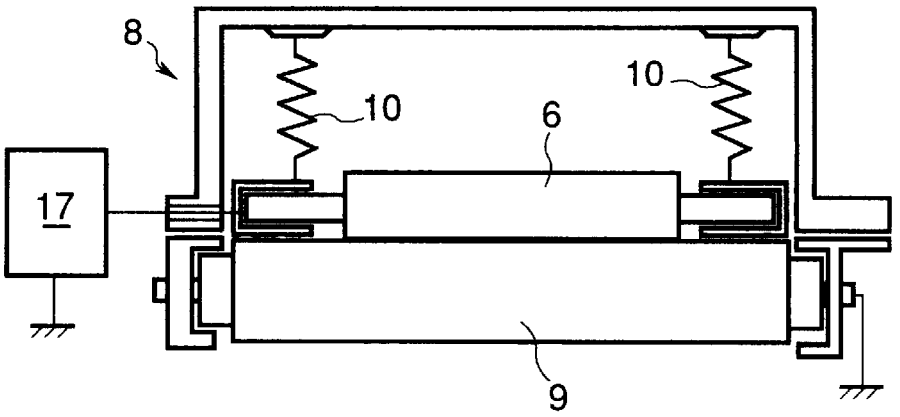
FIG. 6 is a front view of a contact-charging device.

A laser beam printer shown in FIG. 5 was employed as the electrophotographic apparatus. The printer was driven at a process speed of 94 mm/s (16 ppm) using Photosensitive Member-1, Photosensitive Member-2, or Photosensitive Member-3. The contact charging device shown in FIG. 6 was connected to an external driving motor, and the charging brush roller was rotated in pressure contact with the photosensitive member in the direction counter to the photosensitive member rotation at a 200% peripheral speed of that of the photosensitive member. When the charging belt member was employed, the speed was adjusted to 130% in a counter direction. Durability tests on image printing of 20000 sheets were conducted under low-temperature and low-humidity conditions (20° C., 20%) by application of DC of −750 V for Photosensitive Member-1 and Photosensitive Member-2, or DC of +750 V for Photosensitive Member-3.

The image quality was evaluated by four grades shown in Table 3. The evaluation results are shown in Table 4.

TABLE 3

(Evaluation Level)

| Grade | Evaluation level |
|---|---|
| Excellent | Injection efficiency and fogging degree are both kept at the initial level |
| Good | No fogging occurred during durability test |

TABLE 3-continued (Evaluation Level)

| Grade | Evaluation level |
|---|---|
| Fair | Fogging occurred during durability test |
| Poor | poor charging from the initial stage |

The charging efficiency was derived from the equation (1) below:

$$R=(H/V)\times100[\%] \quad (1)$$

where R is the charging efficiency, V is an applied voltage (volt), and H is a charged potential of the photosensitive member (volt).

For uniform charging, the charging efficiency is required to be higher than 90%. At the charging efficiency lower than 90%, charging will be insufficient causing image fogging and lowering the image quality.

TABLE 4

(Results of Examples 4–6 and Comparative Examples 2–4)

| | Photosensitive Member-1 | | Photosensitive Member-2 | | Photosensitive Member-3 | |
|---|---|---|---|---|---|---|
| | Efficiency (%)* | Image quality ** | Efficiency (%)* | Image quality ** | Efficiency (%)* | Image quality ** |
| Example | | | | | | |
| 4 | 96 | Excellent | 96 | Excellent | 96 | Excellent |
| 5 | 96 | Excellent | 96 | Excellent | 96 | Excellent |
| 6 | 96 | Excellent | 96 | Excellent | 96 | Excellent |
| 7 | 96 | Excellent | 96 | Excellent | 96 | Excellent |
| 8 | 96 | Excellent | 96 | Excellent | 96 | Excellent |
| Comparative Example | | | | | | |
| 2 | 45 | Poor | 45 | Poor | 50 | Poor |
| 3 | 65 | Poor | 65 | Poor | 70 | Fair |
| 4 | <20 | Poor | <20 | Poor | <20 | Poor |

*Charging efficiency,
**Image quality after endurance test

What is claimed is:

1. A charging member, which electrically charges an object to be charged by being placed in contact with the object to be charged and by being applied with a voltage, said charging member comprising:

an electroconductive base; and contact brush bristles that come into contact with the object to be charged, said contact brush bristles including at least one of etching fibers and divided fibers obtained from a conjugate fiber.

2. The charging member according to claim 1, wherein said contact brush bristles include an etching fiber.

3. The charging member according to claim 1, wherein said contact brush bristles include a divided fiber.

4. The charging member according to claim 1, wherein the object to be charged is an electrophotographic photosensitive member.

5. The charging member according to claim 4, wherein the electrophotographic photosensitive member includes a charge injection layer.

6. The charging member according to claim 1, wherein said contact brush bristles have an average diameter ranging from 0.05 to 30 μm.

7. The charging member according to claim 6, wherein said contact brush bristles include an etching fiber.

8. The charging member according to claim 6, wherein said contact brush bristles include a divided fiber.

9. The charging member according to claim 6, wherein the object to be charged is an electrophotographic photosensitive member.

10. The charging member according to claim 9, wherein the electrophotographic photosensitive member includes a charge injection layer.

11. A process cartridge comprising:

an electrophotographic photosensitive member; and at least one of a charging member provided in contact with said electrophotographic photosensitive member to electrically charge said electrophotographic photosensitive member, developing means, and cleaning means, wherein said charging member includes an electroconductive base and contact brush bristles that come in contact with said electrophotographic photosensitive member, wherein said contact brush bristles include at least one of etching fibers and divided fibers obtained from a conjugate fiber, and wherein said electrophotographic photosensitive member and said at least one of said charging member, said developing means, and said cleaning means are supported in one unit to be mountable to and demountable from an electrophotographic apparatus.

12. The process cartridge according to claim 11, wherein said contact brush bristles include an etching fiber.

13. The process cartridge according to claim 11, wherein said contact brush bristles include a divided fiber.

14. The process cartridge according to claim 11, wherein said electrophotographic photosensitive member contains a charge injection layer.

15. The process cartridge according to claim 11, wherein said contact brush bristles have an average diameter ranging from 0.05 to 30 $\mu$m.

16. The process cartridge according to claim 15, wherein said contact brush bristles include an etching fiber.

17. The process cartridge according to claim 15, wherein said contact brush bristles include a divided fiber.

18. The process cartridge according to claim 15, wherein said electrophotographic photosensitive member contains a charge injection layer.

19. An electrophotographic apparatus comprising:

an electrophotographic photosensitive member;

a charging member provided in contact with said electrophotographic photosensitive member to electrically charge said electrophotographic photosensitive member;

light exposure means;

developing means; and image transfer means, wherein said charging member includes an electroconductive base and contact brush bristles to come into contact with said electrophotographic photosensitive member, said contact brush bristles including at least one of etching fibers and divided fibers obtained from a conjugate fiber.

20. The apparatus according to claim 19, wherein said contact brush bristles include an etching fiber.

21. The apparatus according to claim 19, wherein said contact brush bristles include a divided fiber.

22. The apparatus according to claim 19, wherein said electrophotographic photosensitive member has a charge injection layer.

23. The apparatus according to claim 19, wherein said contact brush bristles have an average diameter ranging from 0.05 to 30 $\mu$m.

24. The apparatus according to claim 23, wherein said contact brush bristles include an etching fiber.

25. The apparatus according to claim 23, wherein said contact brush bristles include a divided fiber.

26. The apparatus according to claim 23, wherein said electrophotographic photosensitive member has a charge injection layer.

* * * * *

UNITED STATES PATENT AND TRADEMARK OFFICE

CERTIFICATE OF CORRECTION

PATENT NO. : 5,805,961

DATED : September 8, 1998

INVENTOR(S) : KIYOSHI MIZOE ET AL.

It is certified that error appears in the above-identified patent and that said Letters Patent is hereby corrected as shown below:

On the title page, item [54],

"BRISTLESS," should read --BRISTLES,--.

[56] REFERENCES CITED

U.S. Patent Documents
"2/1983" should read --1/1983--.

Foreign Patent Documents
"63-149669 6/1988 European Pat. Off." should read
--63-149669 6/1988 Japan--.

COLUMN 1

Line 1, "BRISTLESS," should read --BRISTLES,--.

COLUMN 4

Line 9, "charges" should read --charged--.

UNITED STATES PATENT AND TRADEMARK OFFICE

CERTIFICATE OF CORRECTION

PATENT NO. : 5,805,961

DATED : September 8, 1998

INVENTOR(S) : KIYOSHI MIZOE ET AL.

It is certified that error appears in the above-identified patent and that said Letters Patent is hereby corrected as shown below:

COLUMN 11

Line 44, "is" should be deleted.

Signed and Sealed this

Twenty-second Day of June, 1999

*Attest:*

Q. TODD DICKINSON

*Attesting Officer*

*Acting Commissioner of Patents and Trademarks*